US008469671B2

(12) United States Patent
Beez et al.

(10) Patent No.: US 8,469,671 B2
(45) Date of Patent: Jun. 25, 2013

(54) IMPELLER

(75) Inventors: Günther Beez, Schnett/Thüringen (DE); Holger Conrad, Hessberg/Thüringen (DE)

(73) Assignee: MAHLE International GmbH, Stuttgart (DE)

( * ) Notice: Subject to any disclaimer, the term of this patent is extended or adjusted under 35 U.S.C. 154(b) by 812 days.

(21) Appl. No.: 12/223,010

(22) PCT Filed: Jan. 20, 2007

(86) PCT No.: PCT/DE2007/000104

§ 371 (c)(1),
(2), (4) Date: Jul. 18, 2008

(87) PCT Pub. No.: WO2007/085231

PCT Pub. Date: Aug. 2, 2007

(65) Prior Publication Data

US 2009/0016895 A1 Jan. 15, 2009

(30) Foreign Application Priority Data

Jan. 26, 2006 (DE) ..... 10 2006 003 727

(51) Int. Cl.
*F04D 29/38* (2006.01)

(52) U.S. Cl.
USPC ..... 416/241 A; 416/223 B

(58) Field of Classification Search
USPC ..... 416/182, 183, 185, 186 R, 241 A, 416/223 B, 187
See application file for complete search history.

(56) References Cited

U.S. PATENT DOCUMENTS

| | | | | | |
|---|---|---|---|---|---|
| 3,775,024 | A | * | 11/1973 | Ulm et al. | 417/423.3 |
| 4,253,798 | A | * | 3/1981 | Sugiura | 415/98 |
| 4,666,373 | A | * | 5/1987 | Sugiura | 416/185 |
| 6,106,230 | A | | 8/2000 | Burgess | |
| 6,135,710 | A | * | 10/2000 | Araki et al. | 415/206 |
| RE39,733 | E | * | 7/2007 | Morris et al. | 415/111 |

FOREIGN PATENT DOCUMENTS

| | | |
|---|---|---|
| CH | 269 595 | 7/1950 |
| DE | 195 747 | 2/1908 |

(Continued)

OTHER PUBLICATIONS

Hager, J. "Auslegung von Kühlmittelpumpen für Kraftfahrzeugmotoren." ATZ Automobiltechnische Zeitschrift, Vieweg Publishing, Wiesbaden, Germany, vol. 97, No. 2. 1995. pp. 86-90, XP000482854. (ISR).

(Continued)

*Primary Examiner* — Caridad Everhart
(74) *Attorney, Agent, or Firm* — Collard & Roe, P.C.

(57) ABSTRACT

The invention relates to closed impellers (1) for centrifugal pumps used for conveying homogeneous liquids, especially in cooling systems of motor vehicles. The aim of the invention is to develop a novel design of closed impellers (1) for centrifugal pumps used for conveying homogeneous liquids, especially in coolant pumps, such that closed impellers comprising single-curved blades (3) as well as closed impellers comprising three-dimensionally curved blades (3) can be produced at a low cost while the effect of cavitation wear is minimized on the parts/subassemblies that are mounted downstream of the impeller and the hydraulic efficiency as well as the suction behavior of the respective impeller design is significantly improved. The aim is achieved by a closed impeller (1) for centrifugal pumps which is characterized in that the width of the blade channel continuously increases from the feeding point of the flow into the impeller to the discharge point of the flow from the impeller (1) from a perspective of the meridian section such that the ratio between the width (b2) in the discharge point and the width (b1) at the feeding point ranges from 1.01 to 1.2.

3 Claims, 3 Drawing Sheets

FOREIGN PATENT DOCUMENTS

| | | |
|---|---|---|
| DE | 843 812 | 7/1952 |
| DE | 897 801 | 11/1953 |
| DE | 197 42 023 | 3/1999 |
| WO | WO 97/21927 | 6/1997 |

OTHER PUBLICATIONS

International Search Report.

Hager, J. "Auslegung von Kühlmittelpumpen für Kraftfahrzeugmotoren." ATZ Automobiltechnische Zeitschrift, Vieweg Publishing, Wiesbaden, Germany, vol. 97, No. 2. 1995. pp. 86-90, XP000482854. (with English Abstract).

Gülich, J. F., "Kreiselpumpen", Handbuch für Entwicklung, Anlagenplanung und Betrieb, Chapter 7, pp. 285-286.

English Translation of International Preliminary Report on Patentability.

Pfleiderer et al., "Strömungsmaschinen" [Flow Machines], Springer, 1972, 1980, 1991 and 2005, pp. 45, 142, 144 and 145.

* cited by examiner

IMPELLER

CROSS REFERENCE TO RELATED APPLICATIONS

This application is the National Stage of PCT/DE2007/000104 filed on Jan. 20, 2007, which claims priority under 35 U.S.C. §119 of German Application No. 10 2006 003 727.8 filed on Jan. 26, 2006. The international application under PCT article 21(2) was not published in English.

BACKGROUND OF THE INVENTION

1. Field of the Invention

The invention relates to closed impellers for centrifugal pumps, for conveying homogeneous liquids, particularly for use in motor vehicle cooling systems.

2. The Prior Art

In the prior art, various construction forms of closed impellers have been previously described.

For example, in DE patent 843 812, a construction form of an impeller for centrifugal pumps for conveying non-homogeneous substances (substances having an elevated gas or solid content) is previously described, which is characterized by a special channel and impeller wheel configuration, by means of which an attempt is made to cancel out the usual de-mixing effect of the centripetal field of the centrifugal pumps. The arrangement presented there is particularly characterized by at most four main blades, between which mixing blades are disposed on the outer circumference.

This arrangement represents a compromise for conveying non-homogeneous substances. However, optimal conveying of liquids, for example with regard to the degree of effectiveness, the pressure build-up, the characteristic line stability, etc., can by no means be implemented by means of this arrangement and blade wheel design presented in DE patent 843 812. Furthermore, such an impeller is cost-intensive in production, and also cannot in any case be produced in one piece, as a closed impeller.

Another construction form of a blade wheel for conveying non-homogeneous substances is previously described in CH patent 269 595. In this connection, an additional increase in cross-section from the entry towards the exit of the impeller channel is proposed for conveying conveyed media that contain gas, in practically all the consistencies that occur, along with a negative (by an angle $\alpha$) blade overlap, in order to intentionally force a partial vacuum zone to occur in the channel, by means of detachment, which zone then allows conveying conveyed media that contain gas, in practically all the consistencies that occur.

However, even this arrangement by no means allows optimal conveying of homogeneous liquids, particularly with regard to its operational parameters, such as degree of effectiveness, suction behavior, pressure build-up, conveying height, characteristic line stability, etc.

All the closed impellers previously described in the prior art for conveying homogeneous liquids, whether in the construction form of radial blade wheels having blades curved in two or three dimensions, or in the construction form of Francis blade wheels, or diagonal blade wheels having blades spatially curved exclusively in three dimensions, always have an exit width (b2) of the blade channel that is reduced as compared with the entry width (b1), in section through the axis of rotation and the flow channel, i.e. in the meridian section, in order to bring about an increase in the flow velocity of the conveyed medium in the impeller.

One of these construction forms, with simply curved blades and a rectangular flow channel cross-section, is presented in DE patent 195 747, for example.

In the case of another closed impeller construction form, presented in DE patent 897 801, for example, the channel width remains the same at first, in the region of the flow entry, and then narrows towards the flow exit.

As a result of this exit width (b2) of the blade channel, which is reduced as compared with the entry width (b1) in the meridian section, the production of closed impellers for centrifugal pumps is connected with clearly increased production effort and expenditure as compared with the relatively uncomplicated production of open impeller forms for the centrifugal pump systems.

The open impeller construction forms are generally produced in one piece, using the plastic injection-molding method, from plastic, for example from a thermoplastic or duroplastic material.

The closed construction forms of impellers can also be produced from plastic.

However, for this purpose, an open blade wheel having blades curved in one or two dimensions must first be produced, which is then connected with a separately produced cover disk, to form a closed impeller, in a subsequent work step.

On the other hand, however, closed impellers having blades curved in one or two dimensions can also be produced in one piece, for example, as plastic injection-molded parts, using divided slides. It is true that the work step of assembly of the cover disk is eliminated, but then, clearly higher tool costs also necessarily occur.

In general, closed impellers having spatially curved blades, as compared with closed impellers having blades curved in two dimensions (e.g. having a rectangular flow channel cross-section, as presented in DE patent 195 747), have a larger specific diameter, poorer suction behavior, and also an increased risk of cavitation, at the same conveying performance.

In addition, the degree of hydraulic effectiveness of closed impellers having simply curved blades that can be reached amounts to maximally 70%.

In comparison with this, a degree of hydraulic effectiveness of up to 87% can be achieved with closed (rapid-running) impellers having spatially curved blades.

However, until now, the major hindrance for use of closed, rapid-running impellers having spatially curved blades on a large technical scale, for example for use as impellers in coolant pumps in engine and automobile construction, has always been their complicated and therefore cost-intensive production.

The impellers for coolant pumps, which are necessarily relatively small and furthermore have a very complicated structure, with their spatially curved blades, had to be produced in very cost-intensive manner, because of their complicated removal from a mold, predominantly as investment casting parts, using the lost wax process, or using the sand mold casting process, and were therefore unsuitable for large-scale use.

In addition, there was the problem that in the case of these relatively small construction forms, the possibilities for cleaning and polishing the casting surfaces inside the impeller are very limited, so that furthermore, the surface quality that could be achieved was also very greatly restricted.

As a result of this relatively great surface roughness, which necessarily remained due to the production method, the maximal degree of effectiveness that could be achieved was also very greatly impaired.

Therefore, the applicant of the present invention proposed a new type of construction form for closed, rapid-running impellers having spatially curved blades, in DE 197 42 023 B4, which is characterized not only by precisely defined blade shapes, a high level of blade surface quality, good concentricity properties, a high level of reliability, minimized effort and expenditure for production and assembly, as well as a high degree of effectiveness.

This construction form, which was proposed in DE 197 42 023 B4 and has proven itself many times in practical use, is characterized by a segmentation of the impeller, whereby the division of the impeller, in each instance, always takes place in the region of the blades, and in this connection leads to easily unmoldable impeller segments, which can also be produced from plastic, for example, in cost-advantageous manner.

These individual impeller segments are joined together, after their production, in a separate work step, to form an impeller having spatially curved blades, and in this connection are clamped together with one another by means of a bottom disk and/or a clamping ring.

In this connection, the impeller material plastic, which is mostly used in series production, allows not only cost-advantageous production of the individual components and a high surface quality that can be achieved in relatively cost-advantageous manner, but also low friction resistance, high corrosion resistance with regard to the conveyed medium, and good resistance to cavitation phenomena.

Cavitation occurs in the operational state of the impeller in regions having a low pressure level, i.e. at a pressure below the vapor pressure of the conveyed medium, but the effects of cavitation, i.e. implosion of the cavitation bubbles and the wear that results from this implosion, cavity erosion, always occurs only in the regions having an elevated pressure, i.e. mostly after the impeller.

The components and modules situated there, "downstream" from the impeller in the flow direction, are the pump housing and/or the control housing lid, the cylinder crankcase, the cylinder head, and the like, as the result of integration of the pump into the engine.

However, in modern engines, these "downstream" components are usually made from cast aluminum.

In comparison with plastic, aluminum castings have much poorer resistance to cavitation erosion, so that cavitation that builds up in the impeller in regions having a low pressure level leads to damage caused by cavitation erosion of the components and modules made from cast aluminum that follow the impeller, and this can then lead to total failure of these components/modules after extended long-term operation.

SUMMARY OF THE INVENTION

The invention is therefore based on the task of eliminating the aforementioned disadvantages of the prior art, and of developing a new kind of construction form of closed impellers for centrifugal pumps for conveying homogeneous liquids, particularly for use in coolant pumps, which makes it possible to produce both closed impellers having simply curved blades, and closed impellers having spatially curved blades, in cost-advantageous manner, to minimize the effects of cavitation wear at the components/modules that follow the impeller, and, at the same time, to clearly improve the degree of hydraulic effectiveness and the suction behavior of the impeller construction form, in each instance.

This task is accomplished, according to the invention, by means of an impeller having the closed construction form, for centrifugal pumps, which is characterized in that the width of the blade channel, in the meridian section, continuously increases from the flow entry into the impeller to the flow exit out of the impeller, in such a manner that the ratio of the exit width (b2) to the entry width (b1) lies in the range between 1.01 and 1.2.

As a result of this continually widening exit width (b2), a significant reduction in the flow velocity towards the impeller exit is brought about, both in the case of closed impellers having simply curved blades, and in the case of impellers having spatially curved blades.

This reduction in the flow velocity in the impeller, which is achieved according to the invention, necessarily brings about an increase in the static pressure in the interior of the impeller, taking the energy balance into account ($P/p+w^2$=constant; where P—static pressure; p—density of the flow medium; w—flow velocity).

Because of the intentional pressure increase that occurs in the interior of the impeller, in this connection, according to the invention, the region of implosion of the cavitation bubbles and thus also of the wear that results from this implosion of the cavitation bubbles, the cavitation erosion, is moved out of the components and modules that follow the impeller, and into the impeller, which is made from plastic.

Since the plastic of the impeller has a significantly greater resistance to cavitation erosion as compared with the cast aluminum (of the components that follow the impeller), the effects of cavitation wear of the components/modules that follow the impeller are necessarily reduced to a minimum, or even completely avoided, as a result of the effect, according to the invention, of displacing the region of cavitation erosion into the impeller.

The exit width (b2) can be properly dimensioned (for example according to the "velocity triangle"), as a function of the flow velocity required to build up pressure, and the exit angle, in each instance.

In this connection, the greater exit width can be compensated by way of other parameters, such as a smaller exit angle, the blade thickness, etc., for example.

All the performance data required by the user, in each instance, such as conveying height and volume stream, can be taken into consideration according to the calculation methods that are usual in the state of the art for dimensioning the impeller, in each instance, so that all the performance data required by the user, in each instance, can be reliably achieved by means of this new type of impellers configured according to the invention, and exceeded by means of the solution according to the invention.

According to the invention, the ratio of the exit width (b2) to the entry width (b1) should always lie in the range between 1.01 and 1.2, because recirculation in the impeller occurs to a greater extent with an increasing exit width (b2), and this leads to detachment of the flow.

Such recirculation is intentionally brought about in the state of the art, in various construction forms of impellers for conveying non-homogeneous substances, but necessarily has the result that the suction behavior deteriorates and the degree of effectiveness is lowered.

In this connection, it should be particularly emphasized, in terms of production technology, that as a result of the specially configured impeller geometry, with a continuously increasing width of the blade channel, in the meridian section, from the flow entry into the impeller to the flow exit from the impeller, even unmolding of closed impellers having simply and spatially curved blades, and thus production of impellers according to the invention, as one-piece plastic parts, becomes possible, so that the production effort and expenditure for the impellers according to the invention is significantly simplified as compared with the production of conventional impellers, whereby it becomes possible to produce even small construction sizes having a high degree of hydraulic effectiveness and strong suction behavior in simple and cost-advantageous manner, by means of the solution according to the invention.

In the following, the solution according to the invention will now be explained in greater detail using three exemplary embodiments, in connection with nine figures.

DETAILED DESCRIPTION OF THE PREFERRED EMBODIMENTS

Figure 1:
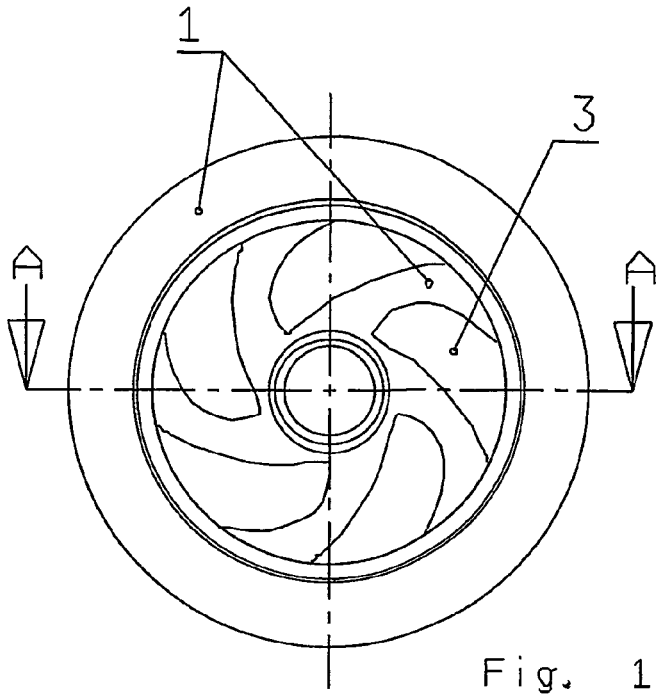
PRIOR ART Fig. 1
FIG. 1: the top view of a radial blade wheel.

FIG. 1 shows an impeller 1 configured as a radial blade wheel having simply curved blades 3, in a top view.

Figure 2:
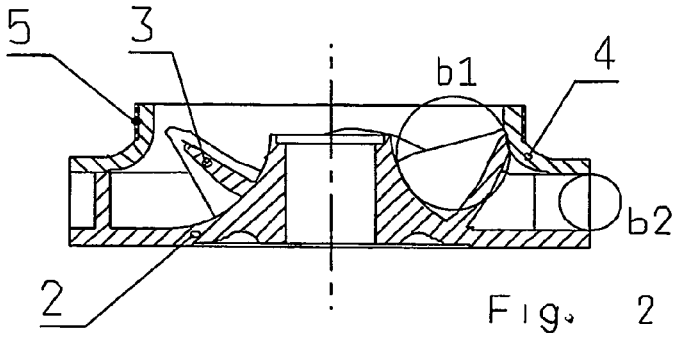
PRIOR ART Fig. 2
FIG. 2: the side view of a radial blade wheel according to FIG. 1, in section, at A-A, according to a construction form according to DE 197 42 023 B4.

FIG. 2 now shows the side view of a radial blade wheel according to FIG. 1, in section, at A-A, according to the "segmented method of construction" previously described in DE 197 42 023 B4, having the bottom 2, the blades 3, a top 4, and a clamping ring 5 that connects the blade segments with one another, and, as is usual in the state of the art, an exit width b2 that is clearly reduced as compared with the entry width b1.

Figure 3:
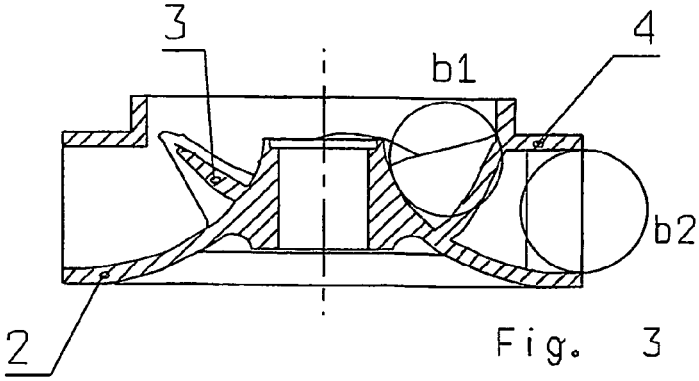
FIG. 3: the side view of the radial blade wheel according to FIG. 1, in section, at A-A, according to the construction form according to the invention.

FIG. 3 shows the side view of the radial blade wheel according to FIG. 1, in section, at A-A, in the construction form according to the invention, in one piece, with the bottom 2, the blades 3, and the top 4, whereby (in contrast to the dimensioning that is usual in the state of the art) the exit width b2 is increased as compared with the entry width b1, according to the invention.

Figure 4:
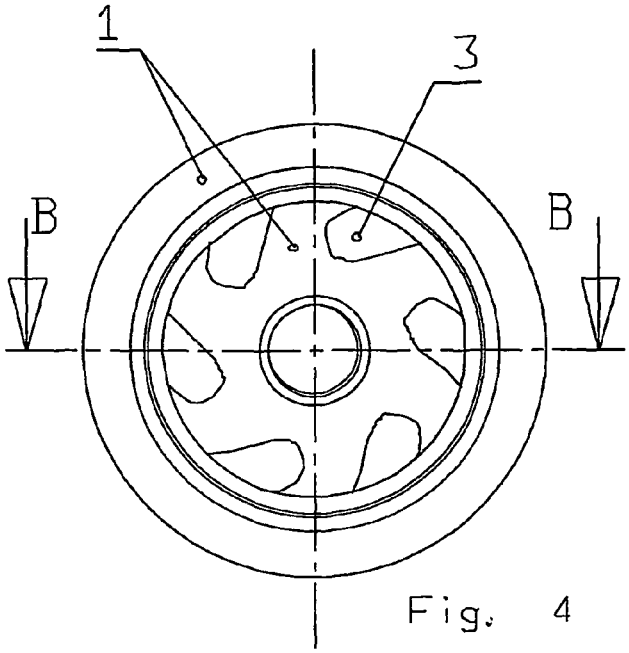
PRIOR ART Fig. 4
FIG. 4: the top view of a Francis blade wheel.

FIG. 4 shows the top view of an impeller 1 configured as a Francis blade wheel having spatially curved blades 3.

Figure 5:
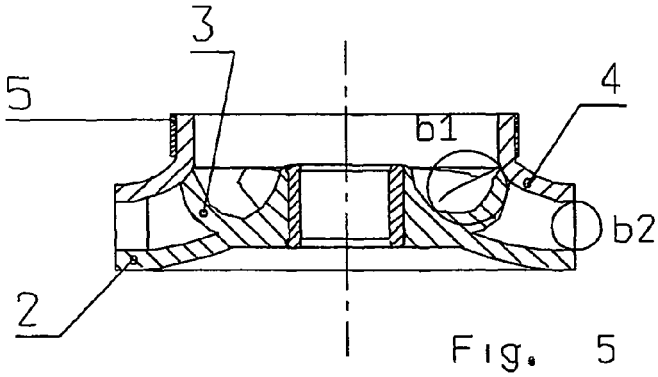
PRIOR ART Fig. 5
FIG. 5: the side view of a Francis blade wheel according to FIG. 4, in section, at B-B, according to a construction form according to DE 197 42 023 B4.

FIG. 5 now shows the side view of a Francis blade wheel according to FIG. 4, in section, at B-B, according to the "segmented method of construction" previously described in DE 197 42 023 B4, with the bottom 2, the blades 3, a top 4, and a clamping ring 5 that connects the blade segments with one another, and, as is usual in the state of the art, an exit width b2 that is clearly reduced as compared with the entry width b1.

Figure 6:
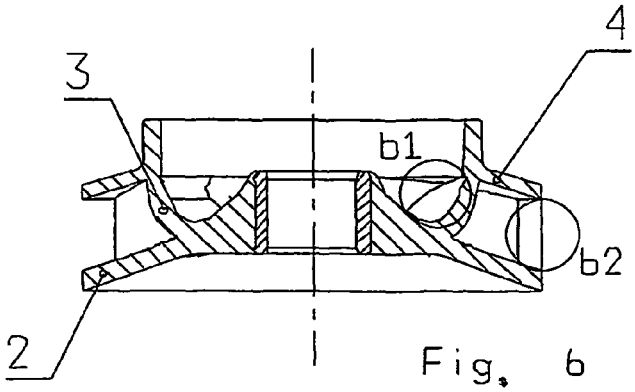
FIG. 6: the side view of the Francis blade wheel according to FIG. 4, in section, at B-B, according to the construction form according to the invention.

FIG. 6 shows the side view of the Francis blade wheel according to FIG. 4, in section, at B-B, according to the construction form according to the invention, in one piece, with the bottom 2, the blades 3, and the top 4, whereby (in contrast to the dimensioning that is usual in the state of the art) the exit width b2 is increased as compared with the entry width b1, according to the invention.

Figure 7:
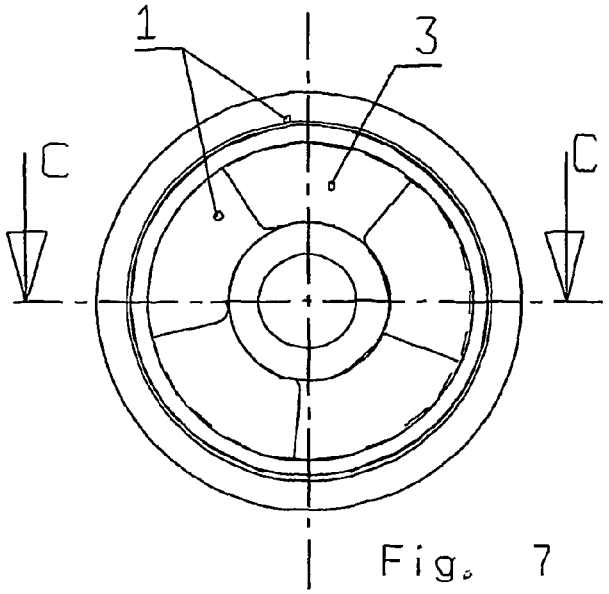
PRIOR ART Fig. 7
FIG. 7: the top view of a diagonal blade wheel.

FIG. 7 shows the top view of an impeller 1 configured as a diagonal blade wheel, with spatially curved blades 3.

Figure 8:
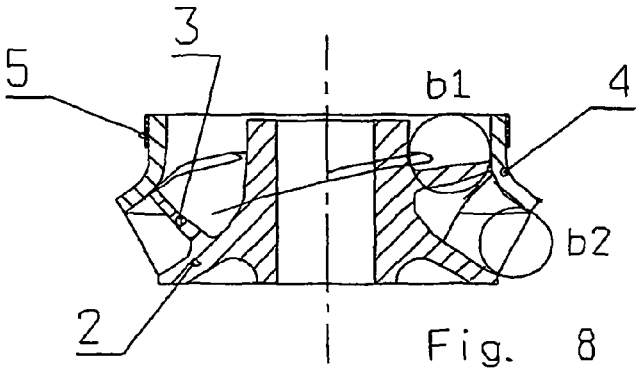
PRIOR ART Fig. 8
FIG. 8: the side view of a diagonal blade wheel according to FIG. 7, in section, at C-C, according to a construction form according to DE 197 42 023 B4.

FIG. 8 now shows the side view of a diagonal blade wheel according to FIG. 7, in section, at C-C, according to the "segmented method of construction" previously described in DE 197 42 023 B4, with the bottom 2, the blades 3, a top 4, and a clamping ring 5 that connects the blade segments with one another, and, as is usual in the state of the art, an exit width b2 that is clearly reduced as compared with the entry width b1.

Figure 9:
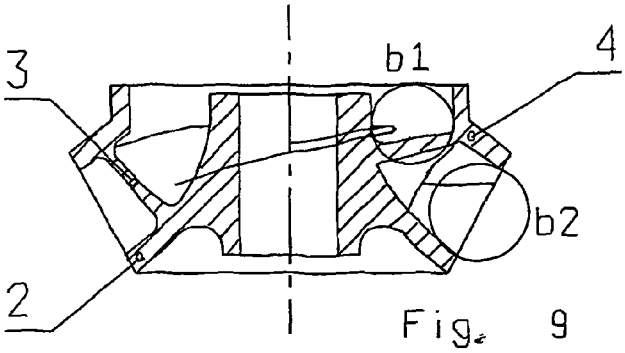
FIG. 9: the side view of the diagonal blade wheel according to FIG. 7, in section, at C-C, according to the construction form according to the invention.

FIG. 9 shows the side view of the diagonal blade wheel according to FIG. 7, in section, at C-C, according to the construction form according to the invention, in one piece, with the bottom 2, the blades 3, and the top 4, whereby (in contrast to the dimensioning that is usual in the state of the art) the exit width b2 is increased as compared with the entry width b1, according to the invention.

On the basis of this increase in exit width b2 as compared with the entry width b1, according to the invention, it has been made possible to produce both closed impellers having simply curved blades and closed impellers having spatially curved blades in cost-advantageous manner, as one-piece plastic parts, to minimize the effects of cavitation wear of the components/modules that follow the impeller, and, at the same time, to clearly improve the degree of hydraulic effectiveness and the suction behavior of the impeller construction form, in each instance, as a result of this specially configured impeller geometry, having a continuously increasing width of the blade channel, in the meridian section, from the flow entry into the impeller to the flow exit from the impeller.

REFERENCE SYMBOL LIST

1 impeller
2 bottom
3 blade
4 top
5 clamping ring
b1 entry width
b2 exit width

The invention claimed is:

1. Impeller, made of plastics, having a closed construction form, for a centrifugal pump in a motor vehicle cooling system, wherein the impeller is a one-piece plastic part, whose width of the blade channel, in the meridian section, continuously increases from the flow entry into the impeller to the flow exit out of the impeller, in such a manner that the ratio of the exit width (b2) to the entry width (b1) lies in the range between 1.01 and 1.2, wherein the impeller has simply curved blades or spatially curved blades, which are arranged between a bottom and a top, and whereat the bottom, the blades and the top form the one-piece impeller; and wherein a degree of hydraulic effectiveness of up to 87% can be achieved with closed (rapid-running) impellers having spatially curved blades.

2. Impeller, made of plastics, having a closed construction form, for a centrifugal pump in a motor vehicle cooling system, wherein the impeller is a one-piece plastic part, whose width of the blade channel, in the meridian section, continuously increases from the flow entry into the impeller to the flow exit out of the impeller, in such a manner that the ratio of the exit width (b2) to the entry width (b1) lies in the range between 1.01 and 1.2, wherein the impeller has simply curved blades or spatially curved blades, which are arranged between a bottom and a top, and whereat the bottom, the blades and the top form the one-piece impeller; and wherein because of intentional pressure increase that occurs in an interior of the impeller, a region of implosion of caviation bubbles and thus also of wear that results from this implosion of the cavitation bubbles, and any caviation erosion, is moved out of components and modules that follow the impeller, and into the plastic impeller.

3. Impeller, made of plastics, having a closed construction form, for a centrifugal pump in a motor vehicle cooling system, wherein the impeller is a one-piece plastic part, whose width of the blade channel, in the meridian section, continuously increases from the flow entry into the impeller to the flow exit out of the impeller, in such a manner that the ratio of the exit width (b2) to the entry width (b1) lies in the range between 1.01 and 1.2, wherein the impeller has simply curved blades or spatially curved blades, which are arranged between a bottom and a top, and whereat the bottom, the blades and the top form the one-piece impeller; and wherein a degree of hydraulic effectiveness of up to 87% can be achieved with closed (rapid-running) impellers having spatially curved blades; and wherein because of intentional pressure increase that occurs in an interior of the impeller, a region of implosion of caviation bubbles and thus also of wear that results from this implosion of the cavitation bubbles, and any caviation erosion, is moved out of components and modules that follow the impeller, and into the plastic impeller.

* * * * *